US006354028B1

(12) United States Patent
Gross et al.

(10) Patent No.: US 6,354,028 B1
(45) Date of Patent: Mar. 12, 2002

(54) ROTATABLE MULTI-FACED SIGN

(75) Inventors: Philip R Gross, Brookfield; Robert J Harruff, Pewaukee, both of WI (US)

(73) Assignee: Everbrite, Inc., Greenfield, WI (US)

( * ) Notice: Subject to any disclaimer, the term of this patent is extended or adjusted under 35 U.S.C. 154(b) by 0 days.

(21) Appl. No.: 09/507,231

(22) Filed: Feb. 18, 2000

(51) Int. Cl.[7] ..... G09F 13/04
(52) U.S. Cl. ..... 40/572; 40/493; 248/349.1
(58) Field of Search ..... 40/572, 747, 493, 40/502, 575, 492, 573, 574, 518, 524; 248/349.1, 510, 487

(56) References Cited

U.S. PATENT DOCUMENTS

| | | | | | |
|---|---|---|---|---|---|
| 241,925 | A | * | 5/1881 | Cadwell | 40/493 |
| 1,835,033 | A | * | 12/1931 | Fischer | 40/747 |
| 3,176,942 | A | * | 4/1965 | Mitchell et al. | 248/487 |
| 3,479,632 | A | * | 11/1969 | Galles | 248/349.1 |
| 4,040,193 | A | | 8/1977 | Matsuda et al. | |
| 4,211,331 | A | | 7/1980 | Salmon et al. | |
| 4,381,616 | A | * | 5/1983 | Saxer | 40/502 |
| 4,503,631 | A | | 3/1985 | Kelly | |
| 4,648,574 | A | * | 3/1987 | Granlund | 248/349.1 |
| 4,860,471 | A | | 8/1989 | Bonanomi | |
| 5,161,321 | A | * | 11/1992 | Kuhnke | 40/493 |
| 5,379,540 | A | * | 1/1995 | Howard | 40/573 |
| 5,796,331 | A | | 8/1998 | Lamparter | |
| 5,818,401 | A | | 10/1998 | Wang | |
| 5,933,990 | A | * | 8/1999 | Keyser et al. | 40/524 |
| 6,105,290 | A | * | 8/2000 | Coates et al. | 40/518 |
| 6,125,565 | A | * | 10/2000 | Hillstrom | 40/574 |

* cited by examiner

*Primary Examiner*—Lynne H. Browne
*Assistant Examiner*—Doug Hutton
(74) *Attorney, Agent, or Firm*—Michael Best & Friedrich LLP

(57) ABSTRACT

A multi-sided display includes a frame and a display sign housing having at least two display surfaces. The housing is supported on an extendable-retractable base which rotatably supports the sign. The display sign can be rotated when the support base is extended, to display a selected one of the display surfaces. The display sign is supported for viewing of the selected surface when the support is retracted. An electrically illuminated light source within the housing is provided for illuminating the display surfaces. The base is preferably supported for extension and retraction by at least one, and usually two telescoping arms. A pair of slide strips located on opposite side edges of a top surface of the base slidably support the housing. The housing is preferably rotatably supported on the base by a central bearing. A latch mechanism is actuatable to release the cabinet for retraction, and after retraction, for rotation.

9 Claims, 9 Drawing Sheets

ROTATABLE MULTI-FACED SIGN

BACKGROUND OF THE INVENTION

The invention relates to illuminated signs or displays. More particularly the invention relates to such signs which are provided with two or more visual display surfaces which can be rotated to present for viewing a selected one of the display surfaces.

Currently there are several types of display units available which can accomplish a change of marketing graphics. One of the most widely used, provides the customer with a framework which holds graphic information. The framework may be installed on a single-faced illuminated cabinet and changed by replacement of the framework. A drawback, however, is the extra framework which is subject to being dropped and made unserviceable during change-out, and a requirement of some storage location for frames not in use.

A second style of changeable sign uses a rolled display surface which contains multiple graphic messages, which are selectively displayed on a single faced cabinet. A means is provided to roll the graphic from one message to the next. Such units are cumbersome to use and require room for the mechanism, which provides a rolling transfer between graphic messages, thus increasing the cabinet width or height to accommodate the mechanism. Also, since the messages are typically rolled onto or over a cylinder, the plastic upon which the graphic message is printed, can become curled at the edges, causing difficulty in reading the message, or requiring additional mechanical devices to control the curl, also adding to the cost.

A need has, thus, continued to exist for improved changeable display signs which are convenient to use and cost effective for use in business establishments, especially, fast food restaurants.

SUMMARY OF THE INVENTION

The invention provides an economical, easy to use, multi-faced advertising sign which is rotatable about an internal axis. Manual rotation of the sign allows the viewing of a selected face ore side of the sign at appropriate times. In a preferred embodiment, the sign is two-sided and provides an improved changeable display for fast food restaurants to selectively display different menu boards at different times of the day. Thus, an illuminated display of breakfast food selections and prices may readily be rotated, at a predetermined time, to display a different menu for the remainder of the day. In accordance with one aspect of the invention the illuminated sign is secured in position when in use and is then movable to an extended position wherein it is readily rotated and, then, secured in an alternative position for use with an alternate display.

Another aspect of the invention is the provision of a mechanism which allows the sign to be moved forward in its framework, rotated about its own axis, and moved back into its original position for viewing of the alternate display surface, An important advantage is the lack of any necessity to change any display information, parts or assemblies except by rotation of the display surface of the sign. An important aspect of the invention is the interrelationship between the illuminated cabinet and a slidable base shelf upon which the cabinet is supported.

In accord with a further aspect of the invention, the support base includes a central bearing which provides a rotational axis, allowing the cabinet to rotate freely about the central axis of the bearing. A passage is preferably provided at the center of the bearing, which allows electricity to be supplied to an illuminable light source in the interior of the sign. In accord with a still further aspect, plastic slide guides may be positioned on opposite sides of the center to enhance the functioning of the support base for rotation thereon, without tipping, of the rotatable illuminable cabinet. The preferred construction supplies stability to the cabinet during rotation, yet, is inexpensive.

In accordance with the preferred embodiment an extendible/retractable mechanism facilitates extension of the support base for rotation of the sign as well as retraction back to a display position. Preferably, telescoping slides similar to standard telescoping cabinet drawer glides are used for the extendible/retractable mechanism. While a single extendible/retractable mechanism could be used, it is preferred that one drawer glide be positioned on each side of the base. For purposes of stability, the preferred embodiment also utilizes third extendible/retractable slide mechanism which is positioned with its wide side horizontally oriented. A stable support base platform is supported on the glides, and may be extended linearly from the fully retracted to the fully extended positions. In the extended position the cabinet can be rotated without interference with the framework supporting it or with other physical structures on either side of the unit.

This sign has the capability to present any selected side of a double, triple or similar multi-faced sign for viewing. The information presented on the sign therefore can especially be tailored to two or more particular marketing situations such as time of day marketing. Most typically such time of day marketing entails presentation of separate breakfast and lunch menus to customers.

This invention utilizes each side of such an illuminated sign to present the information, so that the faces do not need to be physically changed to be presented for viewing. Each illuminated sign unit used in a particular installation can be rotated for presentation of a rear or concealed face for viewing, thus allowing marketing changes to be effected by store personnel easily and efficiently. The sign of this invention is also made as foolproof as possible, for easy use by young or inexperienced workers.

Briefly, the invention provides a multi-sided display includes a frame and a display sign housing having at least two display surfaces. The housing is supported on an extendable-retractable base which rotatably supports the sign. The display sign can be rotated when the support base is extended, to display a selected one of the display surfaces. The display sign is supported for viewing of the selected surface when the support is retracted. An electrically illuminated light source within the housing is provided for illuminating the display surfaces. The base is preferably supported for extension and retraction by at least one, and usually two or three telescoping arms. A pair of slide strips located on opposite side edges of a top surface of the base may slidably support the housing.

The housing is preferably rotatably supported on the base by a suitable bearing which may be formed of a series of stacked flat washers.

In accordance with a further aspect of the invention, a latch mechanism is provided. The preferred latch mechanism includes a first release position which allows the display sign to be retracted but not to be rotated. After full retraction of the sign, the latch mechanism can be moved to a second release position which permits rotation of the sign. After a 180 rotation the latch can be re-engaged to lock the sign in an orientation wherein the previously concealed side of the sign is displayed.

BRIEF DESCRIPTION OF THE DRAWINGS

FIG. 9 is a fragmentary sectional view showing the central cap and bearing/positioning washers at the rotatable axis of the device;

DETAILED DESCRIPTION OF THE INVENTION

Figure 1:
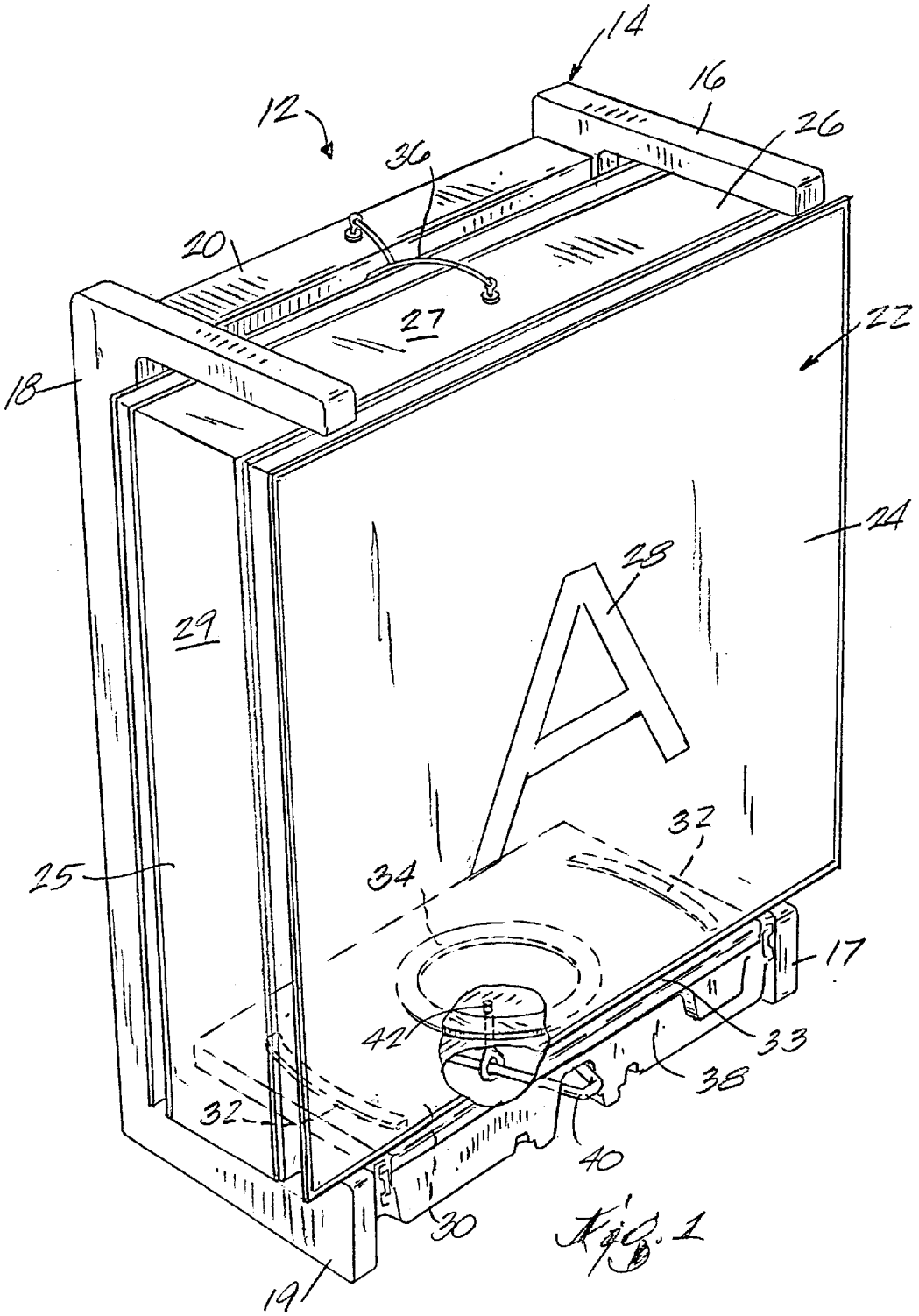
FIG. 1 is an isometric view of a single rotatable unit in accordance with the invention, with some interior parts shown by phantom lines, and with sections broken away to show internal details.
Figure 2:
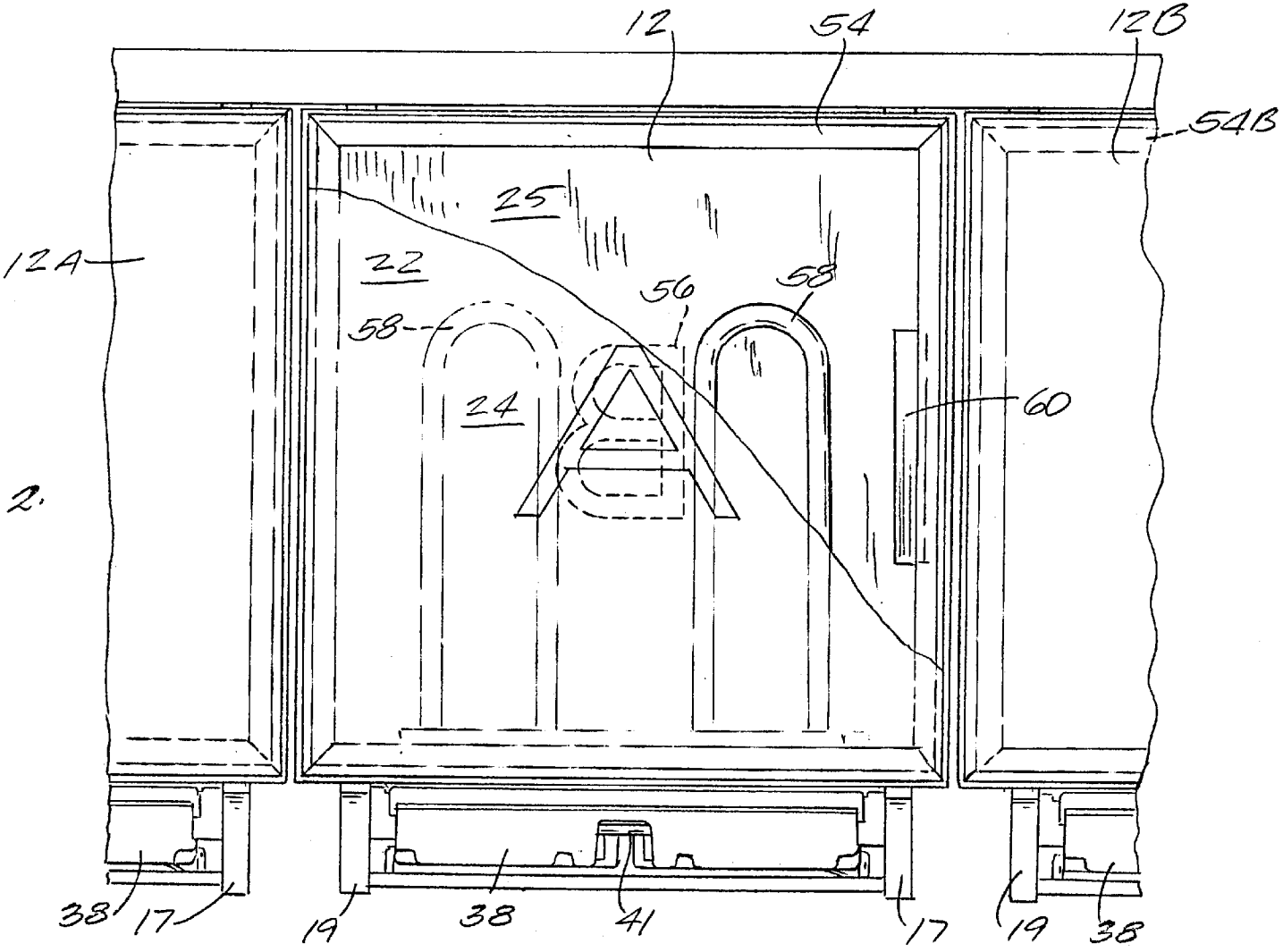
FIG. 2 is a front elevational view, with a front surface partially broken away to show interior details, and showing three rotatable units of this invention in a typical fast food restaurant environment.

Referring to FIG. 1, there is seen a display sign unit 12 of this invention. As shown in FIG. 2 sign unit 12 can be used in conjunction with adjoining similar sign units denoted 12A and 12B.

Unit 12 includes a stationary supporting frame 14 generally mounted to a wall, for example, near the top of a dividing wall between a kitchen area and a serving area in a fast food restaurant. Supporting frame 14 includes a pair of C-shaped side frame members 16 and 18 and one or more cross members such as the one numbered 20 in FIG. 1. The frame members may be formed of extruded aluminum but may also be formed of any suitable material such as steel, rigid plastics, wood, etc.

Display sign unit 12 includes a rotatable cabinet 22 supportably nested in the C-shaped frame members 16 and 18 where it remains locked in place, during normal use, as will be subsequently explained. Cabinet 22 includes front and rear display surfaces 24 and 25, only one of which can be viewed at a time. Surfaces 24 and 25 are affixed to a frame 26 which is preferably formed of top extrusions 27, side extrusions 29 and a bottom panel 30.

As shown in FIG. 1, display panel 24 is provided with display indicia 28. While a single letter "A" is shown to figuratively show the display indicia 28, in actual practice, this display may be, for example, a combination of words, pictures, and pricing information, etc., for a fast food menu. Such displays generally provide various combinations of pictorial graphics and menu information.

As seen also in FIG. 1, the bottom panel 30 of cabinet 22 rests on the tops of bottom legs 17 and 19 of the C-shaped frame members 16 and 18. The bottom panel 30 of cabinet 22 is also supported for extension and rotation on an extendable retractable support base 33. Protruding upwardly from the top surface of support base 33 are supporting glide members 32 and 34 which, respectively, provide perimeter and central support of the bottom panel 30 during extension and rotation of cabinet 22. Outer glide members 32 are spaced apart so that they assist in providing a degree of stability to cabinet 22 against lateral tilting as it is being retracted from the supporting frame 14.

Figure 3:
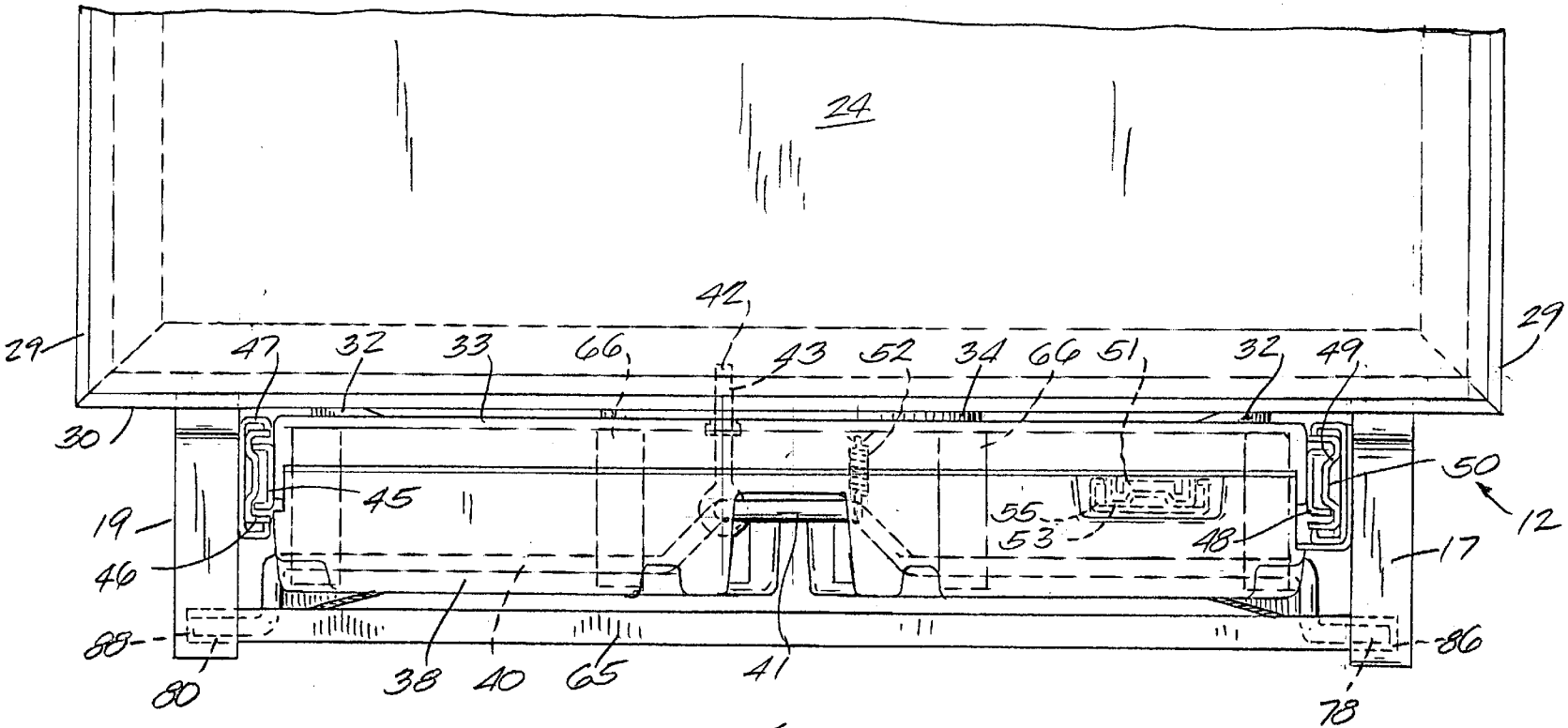
FIG. 3 is a fragmentary front view of the lower portion of a unit of FIG. 1 with some interior parts shown by phantom lines.
Figure 12:
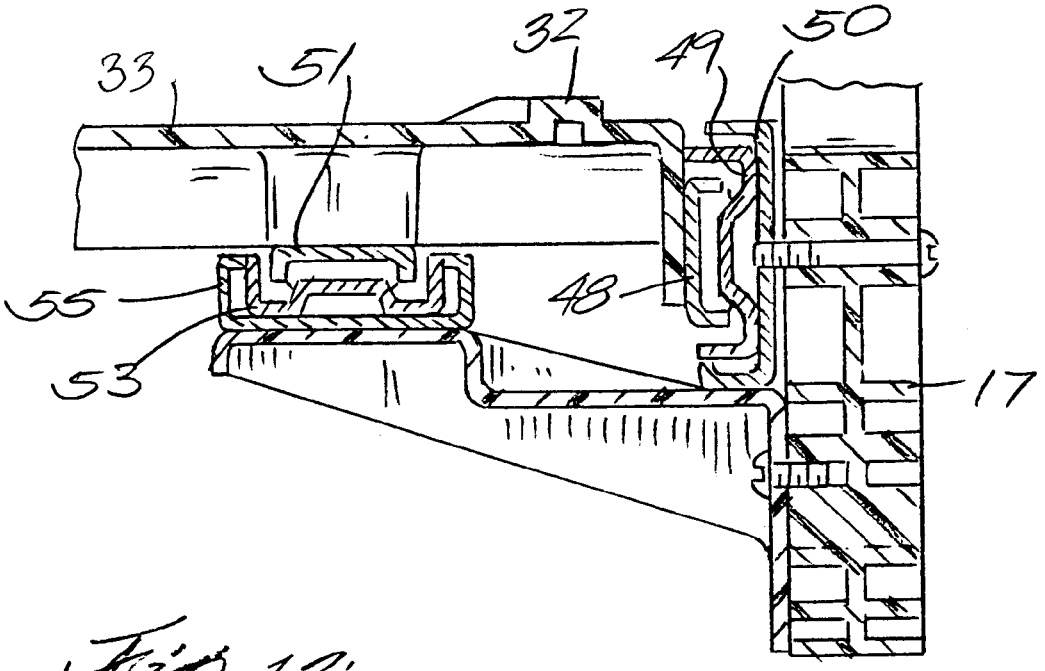

As best seen in FIG. 3 support base 33 is mounted to telescoping drawer slide member 45 which is slidably, telescopingly mounted in a mating slide member 46. Slide member 46 is, in turn, telescopingly mounted in slide member 47, which is fastened to bottom frame leg 19. On the opposite side, support base 33 is affixed to slide member 48 which is slidably, telescopingly mounted within a mating channel-shaped slide member 49 which is slidably mounted within member 50, which is affixed to bottom frame member 17. Also affixed to base 33, as shown in enlarged section in FIG. 12, is a horizontally oriented slide member 51 which is slidably mounted within an intermediate slide member 53. Member 53 is slidably mounted within member 55, which is affixed to a bracket 57 that is, in turn, affixed to leg 17. In order to release the cabinet 22 for sliding outwardly from supporting frame 14, a release lever 40 having a manually accessible handle portion 41, and which retracts a locking pin 42 out of a pin-receiving hole 43 formed in the cabinet bottom 30 is provided. Pin 42 is normally biased upwardly into a locking position by means of a spring 52. Lever mechanism 40, pin 42, spring 52, as well as the telescoping slide members themselves are all concealed by a molded plastic cover 38 which also prevents workers from extending their fingers into these various working parts.

Referring to FIG. 2, a portion of display panel 22 is broken away in order for interior parts of cabinet 12 to be viewed. Mitre-cut reinforcing members 54 provide rigidity and durability to cabinet 12 as will be apparent to those skilled in the art. As noted, display surface 25 is provided with display information 56, graphically illustrated by the letter "B". Thus, letter A may include for example, a breakfast menu with appropriate pictures whereas letter B may be in the form of a luncheon menu with similarly appropriate pictures.

Lamps 58 are provided interiorly of cabinet 22 in order to light the displays 28 and 56 for illuminated viewing by consumers. A ballast 60 of conventional form is provided for illumination of lamps 58 which usually are of a fluorescent type. Also seen in FIG. 1 is a safety cord or chain 36 which prevents cabinet 22 from falling away from supporting frame 14, for example, if it is being inappropriately handled by an employee. Electrical power is provided to ballast 60 by wiring 62 extending through the bottom of the cabinet, as best seen in FIGS. 4 and 5.

Figure 4:
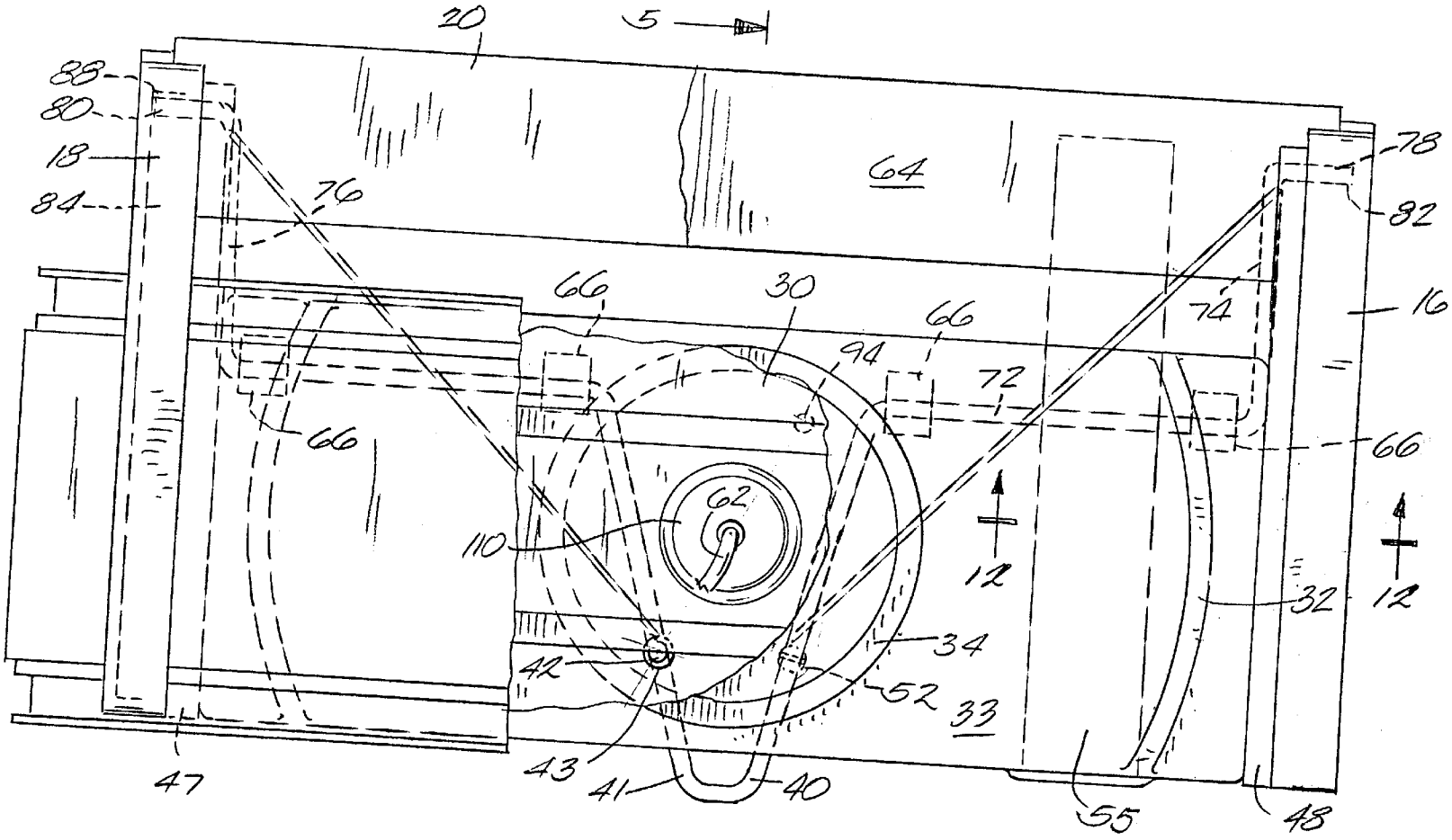
FIG. 4 is a top plan view with parts broken away of the unit shown in FIG. 1.

Also as best seen in FIG. 4, the locking member 40 has a manually accessible forwardly extending handle portion 41 which extends rearwardly to a linear portion 72. Intermediate linear portion 72 of the locking member 40 forms a pivot axis for the locking member 40. A series of hinge bosses 66 mounted to the bottom of surface 33, as seen in FIG. 5, contain horizontal slots 68 which receive the linear portion 72 of the locking member 40. A bolt or pin 70 serves to retain the linear portion of 72 of the locking member 40 in the slots 68 of the hinge bosses 66. Extending rearwardly from linear portion 72 are rearwardly extending arms 74 and 76 which terminate in laterally extending ends 78 and 80, respectively.

Ends 78 and 80 are slidably mounted in tracks 82 and 84 formed in the bottom legs 17 and 19 of the C-shaped frame members 16 and 18. Tracks 82 and 84 each have downwardly extending ends 86 and 88. As seen in FIG. 5, when the end 78 of locking member 40 is downwardly pivoted to its fullest extent into the downwardly extending channel end 86, the cabinet 22 cannot be retracted from the frame 14, where it thus remains locked during use. See also FIG. 6.

Figure 5:
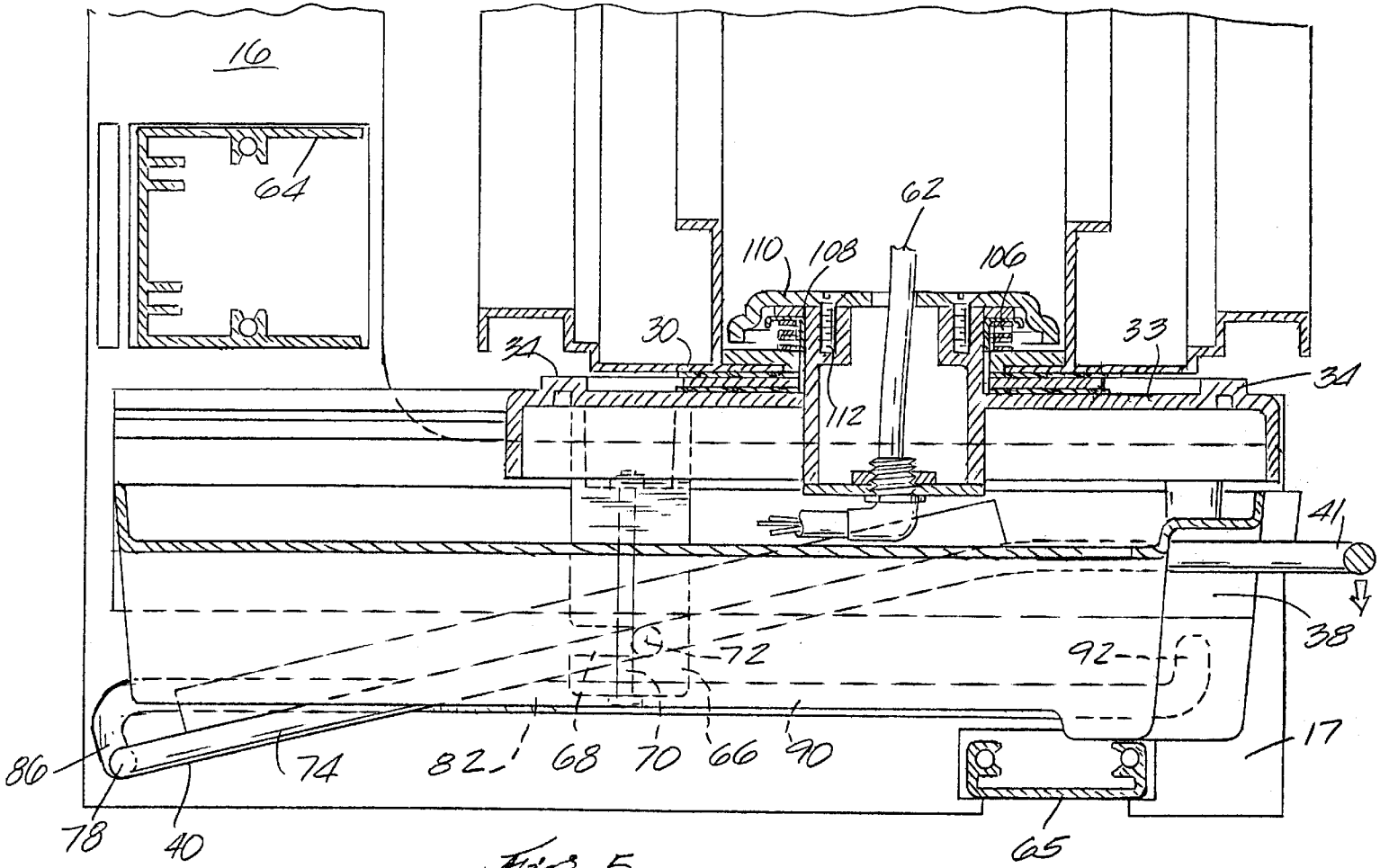
FIG. 5 is a cross sectional view taken along line 5—5 of FIG. 4.
Figure 8:
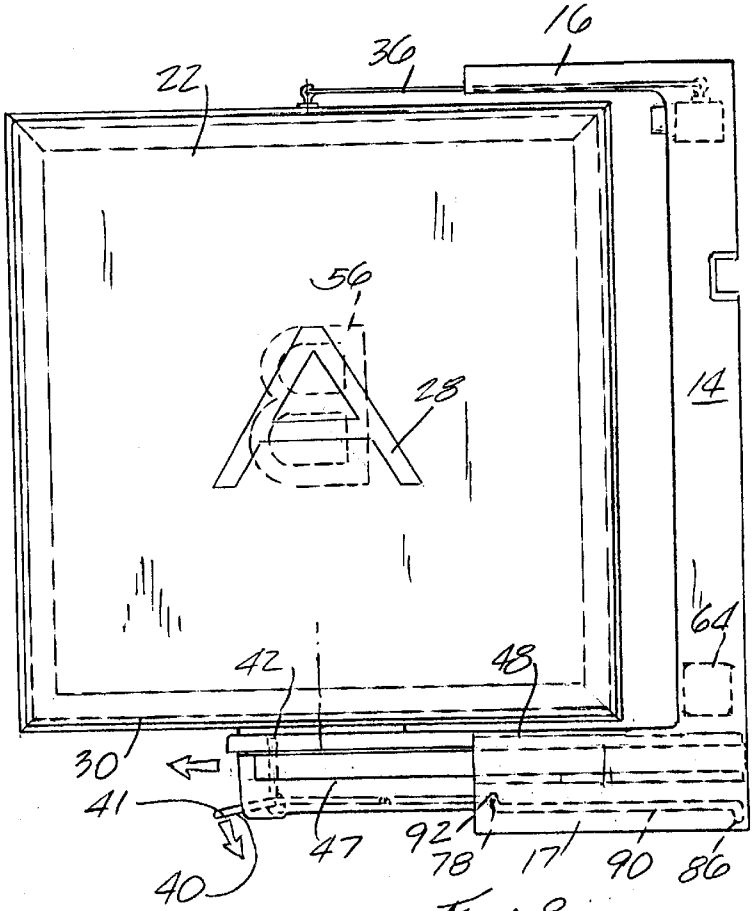
FIG. 8 is a side elevational view of the unit shown in FIG. 6 while it is being rotated.
Figure 7:
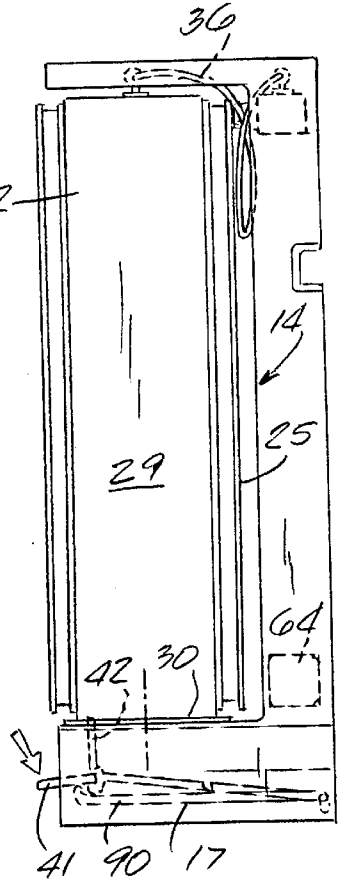
FIG. 7 is a side elevational view similar to FIG. 6 but with the locking mechanism depressed to enable sliding of the unit outwardly from its supporting frame.
Figure 6:
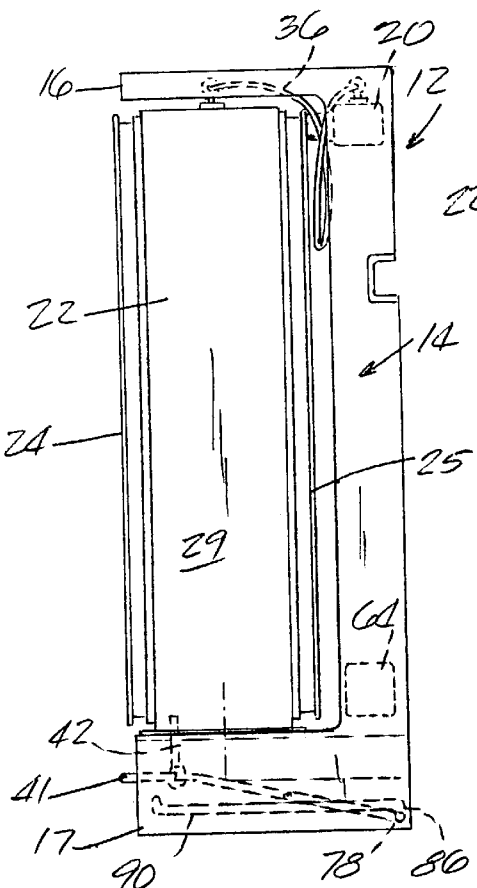
FIG. 6 is a side elevational view of the unit of FIG. 1 with some internal parts shown by phantom lines.
Figure 7:
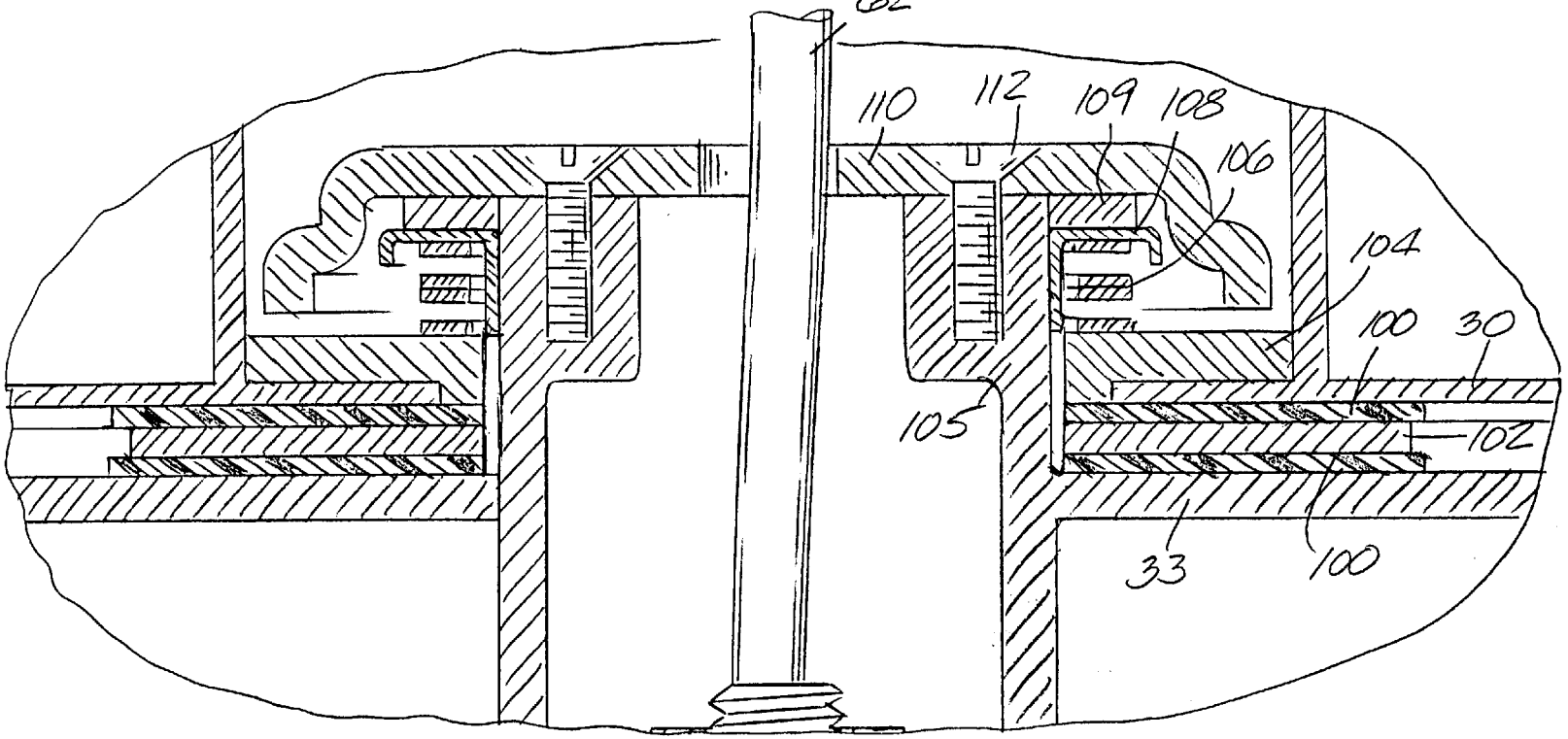
Figure 10:
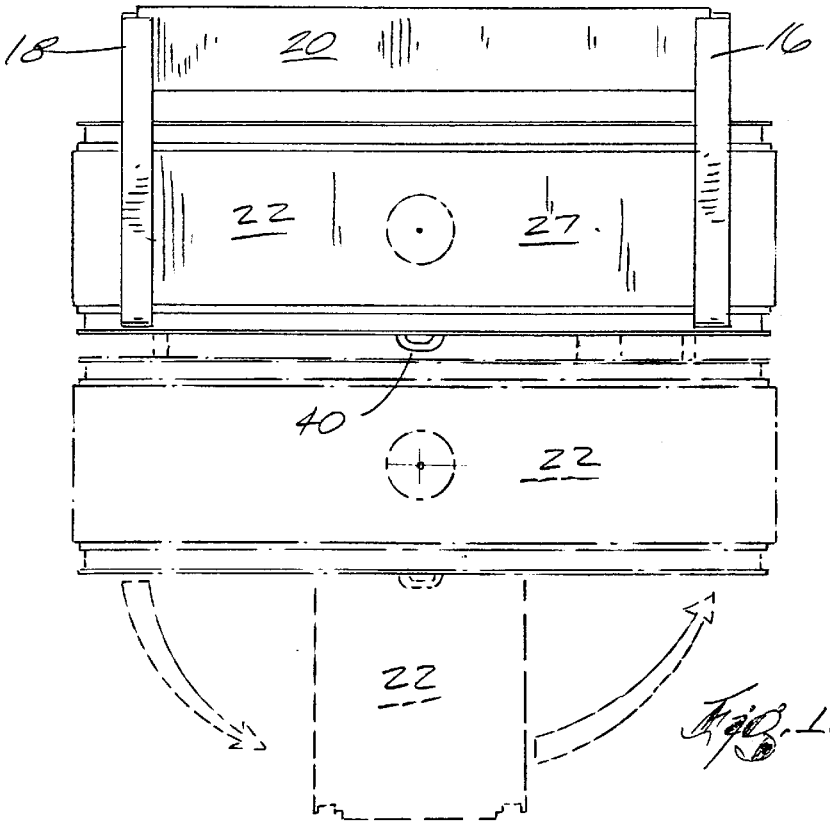
FIG. 10 is a top view of the device of FIG. 1 showing by means of phantom lines the steps undertaken in rotation of the display panel

When the handle 41 of the locking member 40 is depressed in the direction of the arrow in FIGS. 5 and 7 so that laterally extending end 78 pivots upwardly to the level of a linear horizontal segment 90 of track 82, the cabinet 22 can be retracted from the supporting frame 14. Although the cabinet 22 can be slidably retracted, pin 42 still extends into the bottom 30 of cabinet 22 preventing rotation of the cabinet. Each of the tracks 82 and 84 also has an upwardly extending forward end 92. Thus, when cabinet 22 is retracted from frame 14 to its fullest extent, illustrated in FIG. 8, the laterally extending end 78 can move upwardly further into end 92 permitting the pin 42 to drop out of the bottom 30 of cabinet 22 as illustrated in FIG. 8. This enables the cabinet 22 to be rotated around its central vertical axis. The display surface 24 can thus be rotated to the rear while the opposing surface 25 with its display 56 is then in the forward or display position for viewing. The lever 41 can once again be depressed, thus forcing ends 78 and 80 into linear portions 90 of the tracks 82 and 84 so that the steps used in retracting the cabinet from frame 14 can be reversed for retraction of the cabinet 22 into frame 14. A second opening 94 through the bottom 30 of cabinet 22 is provided to receive pin 42 to lock the cabinet in position for viewing of display surface 25.

Also visible in FIGS. 4 and 5 are cross members 64 and 65 of frame 14 which, like cross member 20, may be internally ribbed extrusions in order to provide stability against twisting. Referring again to FIG. 5 and also to FIG. 9, the details of the rotatable connection between the cabinet bottom 30 and support base 33 are shown. As seen with the greatest clarity in FIG. 9, a pair of flat metal washers 100 sandwich a plastic washer 102. As seen, this assembly rests on support base member 33 and also serves to support the cabinet bottom 30. A spacer/locator washer 104 serves to center the cabinet bottom 30 around an upwardly extending of portion 105 of support base member 33. In order to maintain a uniform downward bias on the cabinet base 30, a spring 106, preferably a circular wave spring carried in a bushing 108, is wedged by another washer 109 under a central cap 110. Cap 110, as shown is affixed by screws or otherwise fastened to the upwardly extending central portion 105 of support base 33.

While the illustrated assembly has been found to be preferred, it will be apparent to those skilled in the art that various other types of bushings can be substituted between the cabinet bottom 30 and the support base member 33, for example conventional thrust bearings or the like.

Figure 11:
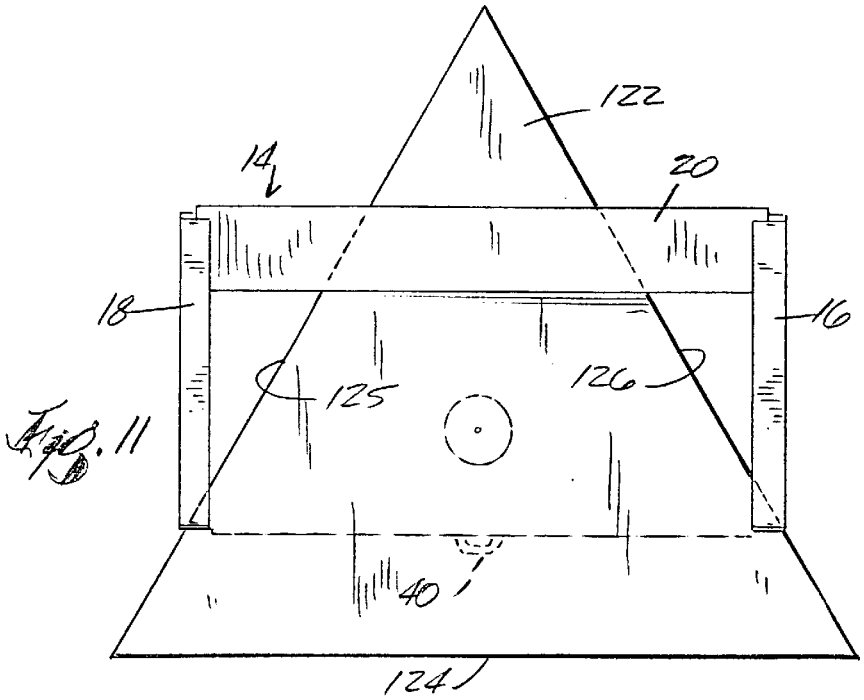
FIG. 11 is a top view showing an alternate embodiment of the invention and, FIG. 12 is a fragmentary sectional view taken along Line 12—12 of FIG. 4.

Referring to FIG. 11, there is shown a further modified embodiment of the invention which provides three display surfaces 124, 125, and 126 on a triangular cabinet 122. Cabinet 122 can be mounted within a supporting frame 14 similar to that described for the preferred embodiment. However, it will be understood that the frame and associated components would be modified, as appreciated by those skilled in the art in order to best accommodate the triangular configuration of the modification of FIG. 11.

While preferred embodiments of the invention have been shown for purposes of illustration it will be apparent to those skilled in the art that various other modifications falling within this scope of the claims will also be possible. It is thus understood therefore that the invention is not limited to the specific forms or embodiment except in so far as such limitations are included in the appended claims.

We claim:

1. A multi-sided display comprising:

a frame;

a display sign housing having a plurality of display surfaces supported by said frame;

an extendable-retractable base rotatably supporting said housing said base being supported for extension and retraction by at least one telescoping arm;

said display sign housing being rotatable when said supporting base is extended, to selectively display a selected one of said display surfaces, and being supported for display of said selected surface when said support is retracted.

2. A display according to claim 1 further comprising an electrically illuminated light source within said housing for illuminating said display surfaces.

3. A display according to claim 1 wherein said base is supported by three telescoping arms.

4. A display according to claim 1 wherein a pair of glide members located on opposite side edges of a top surface of said base slidably support said housing.

5. A display according to claim 1 wherein said housing is rotatably supported on said base by a bearing formed by a flat washer which is downwardly biased by a spring.

6. A display according to claim 5 wherein said spring is a circular wave spring.

7. A display according to claim 5 further comprising a latch mechanism for locking said housing in a said frame and releasing said housing for retraction from said frame.

8. A display according to claim 7 wherein of said latch is movable to a first depressed position to allow such retraction, and when said housing is retracted, said latch is further actuatable to release said housing for rotation in said frame.

9. A multi-sided display comprising:

a frame;

a display sign housing having at least two display surfaces;

an extendable-retractable base rotatably supporting said sign;

said display sign housing being rotatable when said support is extended to selectively display a selected one of said display surfaces, and being supported for display of said selected surface when said support is retracted;

a manually accessible pivotable lock mechanism having a handle extending toward said display surface, said mechanism carrying first means to releasably lock said housing to said frame in the retracted position and a second means releasably engaging said housing to prevent rotation thereof, said first means being releasable by manipulation of said handle for pivoting said mechanism to a first release position wherein said second means remains engaged, but said base is released for extension of said sign, said second means being releasable by further manipulation of said handle after full extension of said sign whereby said housing is released to allow rotation thereof.

* * * * *